US007430820B2

(12) United States Patent
Andreoli et al.

(10) Patent No.: US 7,430,820 B2
(45) Date of Patent: Oct. 7, 2008

(54) FOOT ORTHOSIS AND METHOD OF USE THEREOF

(76) Inventors: Rita J. Andreoli, 37 Meadow St., Thomaston, CT (US) 06787; Paul O. Moore, 256 Fair Oak Rd., Springfield, MA (US) 01128

( * ) Notice: Subject to any disclaimer, the term of this patent is extended or adjusted under 35 U.S.C. 154(b) by 418 days.

(21) Appl. No.: 11/156,999

(22) Filed: Jun. 20, 2005

(65) Prior Publication Data

US 2006/0283051 A1 Dec. 21, 2006

(51) Int. Cl.
*A61F 5/14* (2006.01)

(52) U.S. Cl. ..... 36/140; 36/145; 36/71; 36/166

(58) Field of Classification Search ..... 36/140, 36/91, 88, 145, 166, 180, 71
See application file for complete search history.

(56) References Cited

U.S. PATENT DOCUMENTS

| | | | | |
|---|---|---|---|---|
| 2,190,568 | A * | 2/1940 | Lattemann | 36/145 |
| 2,411,901 | A * | 12/1946 | Silver | 36/145 |
| 2,441,891 | A * | 5/1948 | Lucey et al. | 12/142 N |
| 3,067,752 | A * | 12/1962 | Schaller et al. | 36/145 |
| 4,619,056 | A * | 10/1986 | Lin et al. | 36/43 |
| 5,903,985 | A * | 5/1999 | DeMarchi | 36/155 |
| 6,192,607 | B1 * | 2/2001 | Kolada et al. | 36/145 |
| 6,345,455 | B1 * | 2/2002 | Greer et al. | 36/155 |
| 6,497,058 | B2 * | 12/2002 | Dietrich et al. | 36/69 |
| 6,976,322 | B1 * | 12/2005 | Walker | 36/43 |
| 7,082,702 | B2 * | 8/2006 | Cretinon | 36/88 |
| 2001/0001907 | A1 * | 5/2001 | Luthi | 36/88 |
| 2003/0150134 | A1 * | 8/2003 | Hardt | 36/44 |

OTHER PUBLICATIONS

"Foot Orthoses in Sports Medicine" by Ashley Goodman, Southern Medical Journal, vol. 97, No. 9, dtd. Sep. 2004 article, pp. 867-870.
"The role of selected extrinsic foot muscles during running" by Kristian M. O'Connor and Joseph Hamill, Clinical Biomechanics 19 (2004) pp. 71-77.
"Quantitative comparison of plantar foot shapes under different weight-bearing conditions": by Bonnie Yuk San Tsung, MPhil; Ming Zhang, PhD; Yu Bo Fan, PhD; David Alan Boone, CP, MPhil Journal of Rehabilitation Research and Development, vol. 40, No. 6, Nov./Dec. 2003, pp. 517-526.
"Plantar Fasciitis" by James Russell Ebbets, D.C., NY Chiropractic College, Seneca Falls, NY, pp. 1-9, dtd. Feb. 18, 2005.

(Continued)

*Primary Examiner*—Marie Patterson
(74) *Attorney, Agent, or Firm*—Alix, Yale & Ristas, LLP

(57) ABSTRACT

A foot orthosis device which may be used with footwear to provide arch support for the purpose of relief of physical discomfort such as pain of the foot due to such conditions as over use of longitudinally directed muscles, tendons, and ligaments located between the metatarsal and calcaneal section of the bottom of a human foot. The orthosis device can placed between the existing removable sole and non-removable platform, or above the non-removable sole, or may be integral with a portion of the footwear.

20 Claims, 9 Drawing Sheets

OTHER PUBLICATIONS

"Supporting the Foot" prepared on behalf of Interpod Ltd by Craig Payne, Dept. of Podiatry, School of Human Biosciences, La Trobe University, Bundoora, Vic 3086 Australia, dtd. May 2, 2002.
"The role of orthoses in the treatment of Patellofemoral pain in runners" by S.J. Bartold, The University of South Australia.
"Arch structure and injury patterns in runners" by Dsorsey S. Williams III, Irene S. McClay, and Joseph Hamill, Clinical Biomechanics 16 (2001) pp. 341-347.
"Football boot insoles and sensitivity to extent of ankle inversion movement" by G. Waddington, and R. Adams, Br. J. Sports Med 2003, 37, pp. 170-175.
"A biomechanical perspective: do foot orthoses work?" by B. Heiderscheit, J. Hammill and D. Tiberio; Br. J. Sports Med. 2001, 35, pp. 4-5.
"The influence of orthotic devices and vastus medialis strength and timing on patellofemoral loads during running" by R.R. Neptune; I.C. Wright, A. J. van den Bogert, Clinical Biomechanics 15 (2000) pp. 611-618.
"Effect of Strike Pattern and Orthotic Intervention on Tibial Shock During Running" by Carrie A. Laughton, Irene McClay Davis, and Joseph Hammill, Journal of Applied Biomechanics, 2003, 19, pp. 153-168.

* cited by examiner

FOOT ORTHOSIS AND METHOD OF USE THEREOF

FIELD OF THE INVENTION

This invention relates generally to foot orthosis elements. More particularly, the present invention relates to footwear orthotisis inserts and a method of using the orthosis inserts to enhance and maintain orthopedic function and stability.

BACKGROUND OF THE INVENTION

The human foot is a highly complex and exceedingly strong anatomical structure which is typically able to absorb and distribute high impact forces in a flexible and resilient manner. The human foot and associated ankle include 52 bones and 33 joints. In addition, the foot includes a complex system of muscles that all act upon the toes, and which may be grouped as abductors, adductors, flexors, or extensors. Tendons connect muscles to the bones and are guided and contained between the lower leg and the foot by portions of the fascia located in front of and behind the ankle. The foot includes vascular, connective, adipose, cartilaginous, ligamentous, and nervous tissues. A majority of these components have a general longitudinal orientation relative to the foot. In combination, these components operate in concert to provide the body with support, balance, and mobility. Damage or failure of any one of these components can seriously impair the quality of life of an individual.

Anatomically, the weight of the body in the erect posture is supported by a group of arches formed by the tarsal and metatarsal bones of the foot. The bones forming these arches are connected and reinforced by ligaments and tendons. The predominant arches are the antero-posterior arches, which include the medial and lateral arches. The medial arch is formed by bones which include the calcaneus, the talus, the navicular, the three cuneiforms, and the first, second, and third metatarsals. The apex of the medial arch occurs approximately at the superior articular surface of the talus and the two ends of the arch include the tuberosity on the plantar surface of the calcaneus posteriorly, and the heads of the first, second, and third metatarsal bones anteriorly. The medial arch is reinforced by plantar fascia, plantar ligaments, and intrinsic foot muscles and functions to provide medial stability to the entire foot.

The second antero-posterior arch is the lateral arch, which includes the calcaneus, the cuboid, and the fourth and fifth metatarsals. The apex of the lateral arch occurs approximately at the talocalcaneal articulation and is much less distinct than medial arch. Generally, the lateral arch does not bear as much weight as medial arch and is reinforced by plantar fascia, plantar ligaments, and intrinsic foot muscles.

In the past several decades, athletic endeavors associated with running have been identified with injuries to the lower extremities. Running has been recognized to place enormous stresses on the feet and lower legs. It is often cited that during a typical 5K run, a runner's feet will impact the ground about 3000 times with a force equivalent to about 2-3 times the body weight of the runner. This repetition and force can result in acute and chronic injury. Primarily the injury is attributed to overuse, and many attempts have been made to identify commonalties related to the configuration of the foot that act as a trigger for these injuries. For example, runners with excessively high, cavus, or low, planus, foot arch structures are thought to suffer a higher instance of various lower extremity and foot injuries than runners with moderate or normal foot arch structure. These injuries include: tibial stress syndrome; patellofemoral pain syndrome; posterior tibialis tendinitis; lateral ankle sprains; and/or general knee pain. In addition, overuse injuries are attributable to excessive eversion of the foot being translated into excessive tibial rotation which occurs because of excessive motion at the subtalar joint.

Abnormalities associated with disease conditions, for example, severe rheumatoid arthritis also appear to create gait abnormalities that result in repeated, excessive plantar pressures. Rheumatoid arthritis frequently leads to foot and ankle deformities that ultimately modify the foot strike pattern of the afflicted individual through such things as a greater pronation angle and increased pronation velocity.

Furthermore, normal biomechanical functioning of the foot and ankle complex as well as biomechanical structural changes often occur following trauma to the foot. For example, ankle fractures, calcaneal fractures, subtalar joint dislocations, and/or tarsometatarsal joint dislocations can lead to recurring pain in the lower leg and foot due these biomechanical changes. Such conditions as plantar fasciitis, an inflammation of the heel of the foot, can result from trauma to the plantar fascia of the foot, which in turn can lead to the development of pathologic changes to the patient's gait cycle.

Prevention of the above discussed tissue damage or failure and/or the amelioration or elimination of symptoms associated with damaged or failed tissues have been attempted through the use of conventional orthosis devices. Conventionally, orthoses are devices designed to stabilize or immobilize a portion of the body, prevent deformity, prevent injury and/or provide functional assistance. For example, an orthosis can be associated with the foot so as to protect bone and soft tissue, correct improper tissue alignment, to cushion bones exposed by tissue atrophy, and/or to protect skin from damage due to, for example, neuropathic anesthesia. Typically the term "foot orthoses" is used to reference devices that are placed into shoes. Conventionally foot orthoses have become standard for the treatment of injuries of the foot, ankle, and lower extremity. From a biomechanical perspective, they offer a means of resolving symptoms by placing the foot and the lower extremity in a more advantageous position, thus altering applied tissue stresses. Orthoses have been widely used as part of treatment programs for foot and ankle injuries in sports.

Conventionally, effective orthosis fabrication requires custom fitting on an individual patient basis. This fabrication is typically initiated by first determining the neutral position of the patient's foot and then creating a cast of this neutral position. This time and labor intensive custom fitting is thought to be the best way of reducing abnormal structural pressures, reducing formation of calluses and ulcers, and/or protecting the foot from external trauma. However, in addition to the time and labor requirements, the typical custom fit orthosis does not adequately account for the longitudinal orientation of the muscles, tendons, and ligaments extending between portions of the human foot. The conventional foot orthosis, in contrast, is typically designed longitudinally along the same direction of the muscle, tendon and ligament groups of the arch that are affected by the impact of a foot strike. Furthermore, they commonly require specialized and costly fitting to accommodate various sized human feet as well as adding substantial weight to the foot hardware.

SUMMARY OF THE INVENTION

Briefly stated, the invention in a preferred form is an orthosis insert for footwear having a dorsal surface and a plantar surface. The orthosis insert includes a substantially longitudinally oriented web portion having a posterior end, an anterior end, a medial side and a lateral side. The posterior end, the anterior end, the medial side, and the lateral side may each be formed such that there is varying thickness between the two ends as well as between the two sides. For example, the web portion may include a compound arch such that each end is relatively thinner than at a position intermediate of the two ends, and the web portion between the two sides is of a different thickness.

Attached along the length of the web portion are substantially transversely orientated projections. The transversely orientated projections are attached to the lateral side of the web portion by a root end and extend laterally outwardly from the web portion to a lateral terminus. The transversely orientated projections include a posterior side and an anterior side. Portions of the transversely orientated projections between both the root end and the lateral terminus, and between the posterior side and the anterior side may independently vary in thickness. Adjacent transversely oriented portions are separated by a space.

The longitudinally oriented web portion and the transversely orientated projections of the orthosis insert may include channels. The channels of the web portion may extend or be present at various locations along the length of the web portion. The channels of the transversely orientated projections may extend, or be present at, various locations along the length of at least one of the projections. The channels of the web portion and the transverse projections may in some cases be connected. The channels of the web portion and the transverse projections may each vary in relative volume, depth, shape, and width. The channels of the web portion and the transverse projections may each be fully or partially filled. It should be noted that the channels may in some cases be encapsulated in the material of the web portion and/or transverse projections.

The orthosis insert may be associated with a piece of footwear. For example, the orthosis may be located between a removable sole portion and a non-removable sole portion, or above a removable sole of the foot wear. The orthosis may also be formed integrally with the footwear.

The invention in a preferred form also includes a method of using the orthosis insert to provide relief of physical discomfort, such as pain of the foot due to, for example, over use of longitudinally directed muscles, tendons, and ligaments located between the metatarsal and calcaneal section of the bottom of a human foot. For example, to relieve pain associated with conditions such as plantar fasciitis and/or shin splints through support of structures such as the plantar fascia. The method includes supporting portions of a foot with at least one of the transversely orientated projections such that the web portion extends substantially along the medial foot arch.

An object of the invention is to provide a low cost, lightweight, and efficacious orthosis device for the enhancement and/or maintenance of orthopedic function and stability.

Another object of the invention is to provide a method of supporting portions of the foot such that weight bearing muscles, tendons of the muscle group, and ligament can be supported transversely with the orthosis device.

In general, the material of the invention may be alternately formulated to comprise, consist of, or consist essentially of, any appropriate components herein disclosed. The material of the invention may additionally, or alternatively, be formulated so as to be devoid, or substantially free, of any components, materials, ingredients, or species used in the prior art compositions or that are otherwise not necessary to the achievement of the function and/or objectives of the present invention.

BRIEF DESCRIPTION OF THE DRAWINGS

Other objects and advantages of the invention will be evident to one of ordinary skill in the art from the following detailed description made with reference to the accompanying drawings, in which.

DETAILED DESCRIPTION

The novel features which are considered characteristic for the invention are set forth in the appended claims. The invention itself, however, both as to its construction and its method of operation, can be more fully understood from the following description and accompanying drawings wherein like numerals designate like components throughout, wherein a foot orthosis is generally designated 10.

Figure 2:
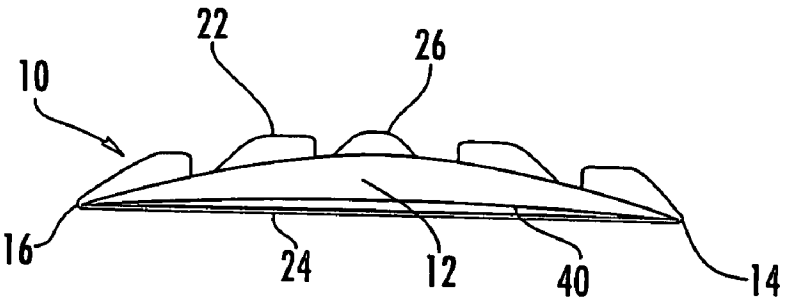
FIG. 2 is a cut away view of the medial side of a foot orthosis having channels in the web portion consistent with the present invention.
Figure 3:
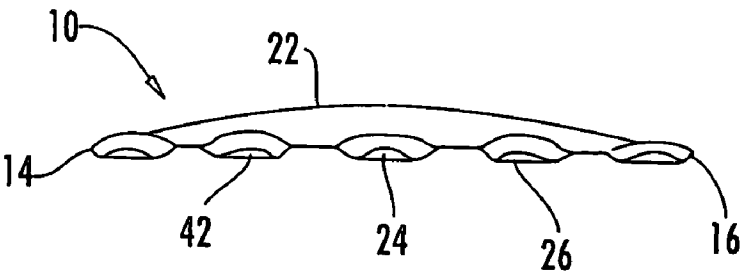
FIG. 3 is a cut away view of the lateral side of a foot orthosis having channels in the transverse portions consistent with the present invention.
Figure 1:
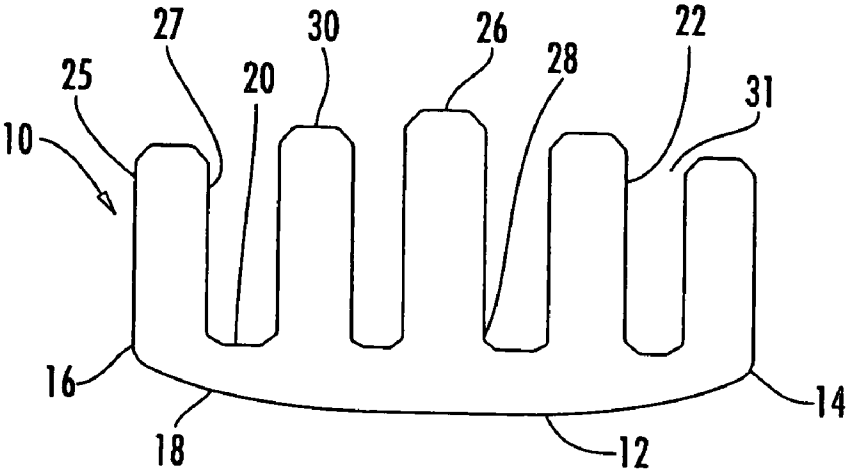
FIG. 1 is a top perspective view of a foot orthosis consistent with the present invention.

The foot orthosis 10, in one embodiment of the present invention, has a dorsal surface 22 being, for example, a therapeutic and/or contoured surface, and a plantar surface 24 and includes a substantially longitudinally oriented web portion 12. The web portion 12 has a posterior end 14, an anterior end 16, a medial side 18, and lateral side 20. The web portion 12 may be configured such that the distance between, for example, the medial side 18 and the lateral side 20 varies along the length of the web portion 12. In addition, the web portion 12 may be configured such that the distance between, for example, the dorsal surface 22 and the plantar surface varies along the length of the web portion 12. For example, the web portion 12 may be configured, as shown in FIGS. 1 and 2, to include a compound arch such that the web portion 12 at each end 14, 16 is relatively narrower than web portion 12 intermediate the two ends, and the web portion 12 between the dorsal and plantar surfaces 22, 24 is thinner at each end 14, 16, than the web portion 12 intermediate the two ends 14, 16.

In one embodiment of the present invention, along the length of the web portion 12, is at least one transversely orientated projection 26 having an anterior side 25 and a posterior side 27, between the anterior side 25 and the posterior side 27 of adjacent projections 26 is a space 31. Each transverse projection 26 is attached to the lateral side 20 of the web portion 12 by a root end 28. For example, the transverse projection 26 may be fixed to the lateral side 20 or may be formed integrally with the web portion 12. The transverse projection 26 extends substantially laterally away from the lateral side 20 of the web portion 12 and terminates at a lateral terminus 30. The lateral terminus 30 may be angular, squared, curved, or otherwise configured. For example, as shown in FIG. 1, the lateral terminus 30 may be rounded. It should be understood that the web portion 12 and the transverse projection 26 may be oriented such that they are not perpendicular.

In one embodiment of the present invention, the transverse projection 26 may be configured such that portions of the transverse projection 26 between the root end 28 and lateral terminus 30, and/or the posterior side 27 and anterior side 25 may vary in thickness. For example, as shown in FIG. 2, the transverse projection 26 may have portions wherein the distance between the dorsal surface 22 and the plantar surface 24 exceed that of the web portion 12.

Figure 14:
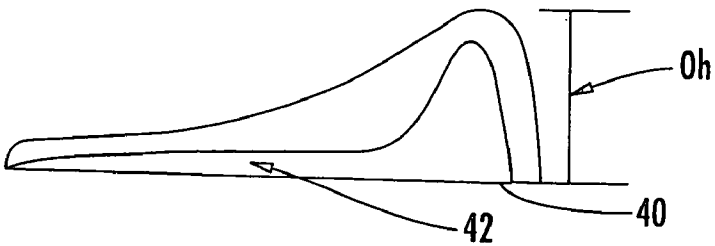
FIG. 14 is a side cutaway view of a foot orthosis along section AA to AA' of FIG. 13 consistent with the present invention.
Figure 13:
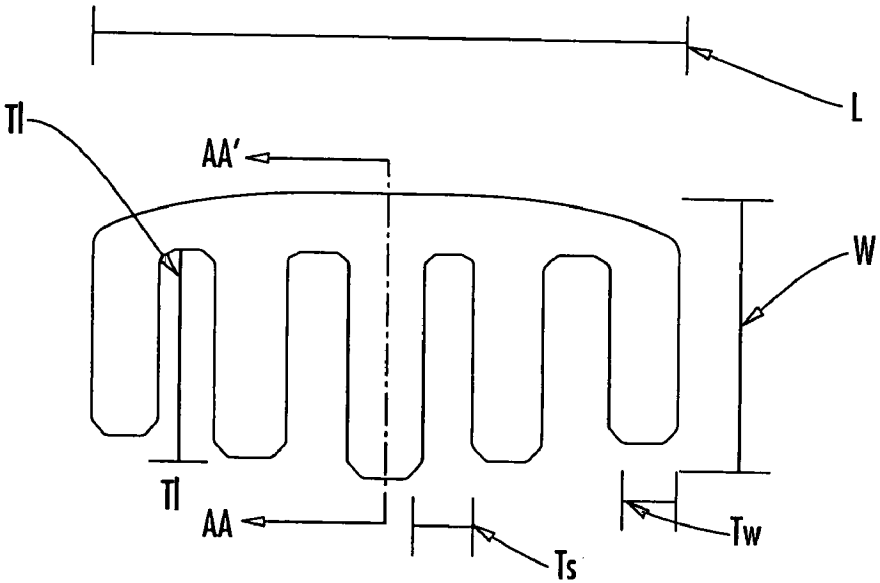
FIG. 13 is a top view of a foot orthosis consistent with the present invention.

The longitudinally oriented web portion 12 and transversely orientated projections 26, in one embodiment of the present invention, as shown in FIG. 13 may be configured to include selected dimensions based on the anatomy of the user. For example, in a preferred form, an orthosis 10 may be configured such that the: longitudinally oriented web portion 12 has a length "L" which is about 4 to about 5 inches; transversely orientated projections 26 having a length "Tl" of about 1 1/18 to about 2 inches; the transversely orientated projections 26 having a width "Tw" of about 3/8 to about 1/2 inches; and a space 31 "Ts" between the transversely orientated projections 26 of about 1/4 to about 3/8 inches. The height of the orthosis "Oh", as shown in FIG. 14, may be between about 1/8 and about 1/2 inches. It should be noted that any and all of these dimensions may be varied independently based on the application and the intended user. For example, the dimensions can be modified such that the height of the orthosis "Oh" is higher than an arch of a patient's foot.

Figure 4:
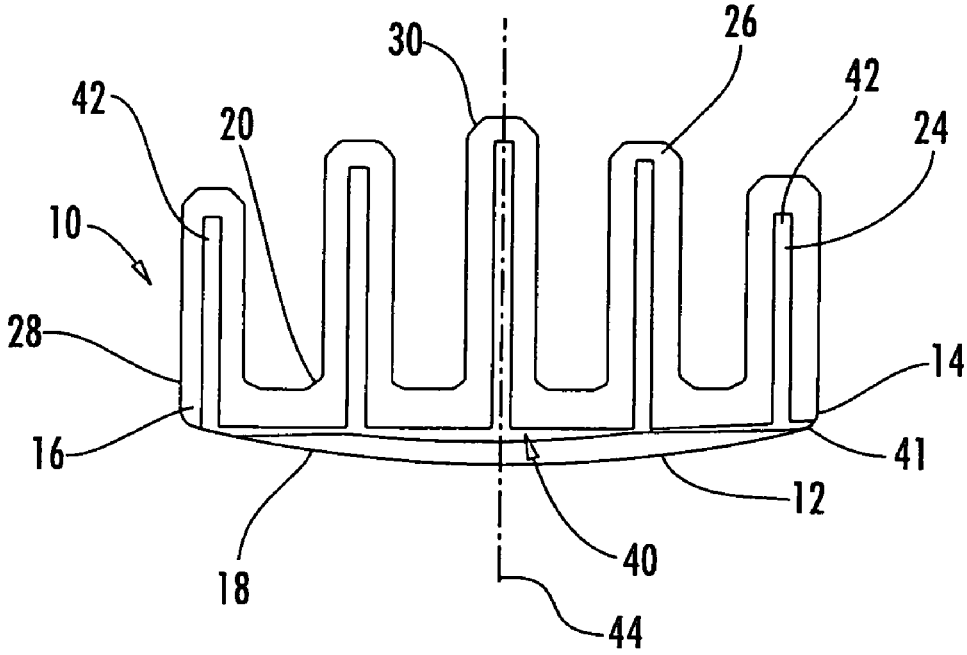
FIG. 4 is a bottom perspective view of a foot orthosis having channels in the web portion and transverse portions consistent with the present invention.

The longitudinally oriented web portion 12 and transversely orientated projections 26, in one embodiment of the present invention, as shown in FIG. 4, may include channels. The channels 40 of the web portion 12 may extend parallel to a midline 41 of the web portion 12. The channels 42 of the transversely orientated projections 26 may extend parallel to a midline 44 of at least one of the projections 26. The channels 40 of the web portion 12 and the channels 42 of transverse projections 26 may be connected. The channels 40 may advantageously vary the supportive nature of the foot orthosis such that, for example, the compression profile of portions of plurality of individual projections is modified.

In some cases, a filler material may be included in the channel. The filler may be, for example a gas, liquid, semi-solid, solid, or gel. Such filler materials include, but are not limited to air; inert gases such as argon, and/or nitrogen; water, and aqueous mixtures of alcohol, glycol, silicone; suspensions and pastes; natural and synthetic polymers; and/or silicone and polymeric gels. It should be understood that a wide variety of other materials fall into the filler material categories. For example, foams, felts, cellulosic elements, and/or other natural or synthetic materials.

In one embodiment of the present invention, the channels 40 of the web portion 12 and the channels 42 of the transverse projections 26 may each vary in relative depth, shape, and width. For example, the channels 40, 42 may be configured as semi-circular or angular channels in the plantar surface 24. The channels 40 can also be a variety of shapes, for example, they may be 1/2 round in the device, round, elliptical, or some other advantageous shape. For example, a filled elliptical would distribute the load better and would have a reduced tendency to protrude vertically through the device during use.

The channels 40, 42 of the web portion 12 and the transverse projections 26 may each be fully or partially filled. For example, in one embodiment of the present invention, the channels may be filled with an uncured silicone polymer such that upon curing, the cured polymer is bonded to the material comprising the web portion 12 and transverse projections 26. This filling material may be chosen based on factors related to hardness, flexibility, compressibility, and/or wear characteristics. The filling material can thus be used to conform the orthosis insert 10 to, for example, a user's arch height specifications in order to provide advantageous arch support. It should be noted that the channels 40, 42 may in some cases be encapsulated in the material of the web portion and/or transverse projections. For example, the channels 40, 42 may be substantially surrounded by material forming the web portion 12 and/or the transverse projections 26. In one embodiment of the present invention, the channels 40, 42 are formed and filled by injection of the filling material along a path parallel to the centerlines 41, 44. The channels 40, 42 may also include tube or bladder elements filled with, for example, gases, liquids, semi-solids, gels and/or solids.

Figure 11:
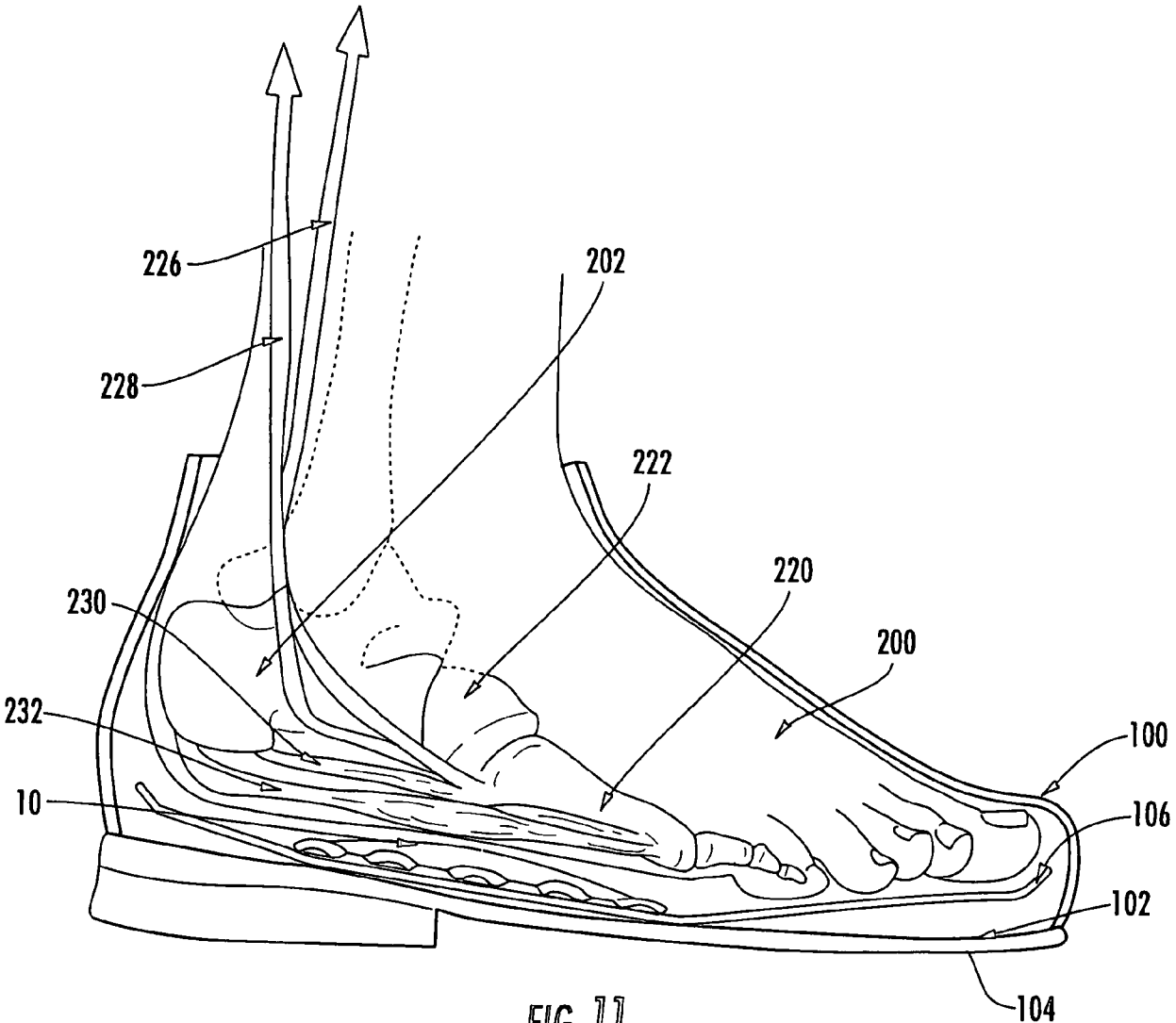
FIG. 11 is a lateral side cut away view of a foot orthosis on top of a removable inner sole associated with a footwear assembly including portions of a foot and lower leg consistent with the present invention.
Figure 12:
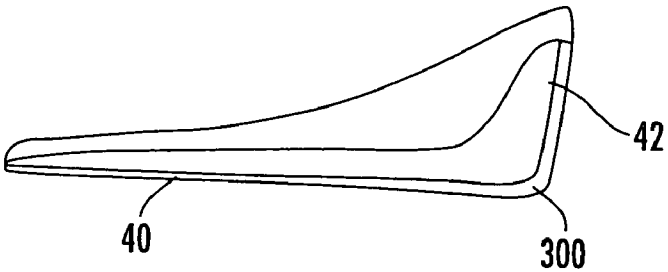
FIG. 12 is a cut away side view of a portion of a foot orthosis having a channel compartmentalized by an associated membrane consistent with the present invention.

In one embodiment of the present, as shown in FIGS. 11 and 12, the channels 40, 42 may be compartmentalized by a membrane 300 which substantially extends over the plantar surface 24. This membrane 300 may be formed integrally with the orthosis 10, or may be fixed to the orthosis 10. The channels may be partially or fully filled with, for example, gases, liquids, semi-solids, gels and/or solids. For example, the channels 40, 42, may be filled with silicone gel.

In one embodiment of the present invention, the foot orthosis 10 can be formed of a variety of materials having advantageous properties with regard to supporting portion of the foot and lower leg. These properties include, for example, hardness, flexibility, compressibility, and/or wear properties. The hardness range of the material, for example, may be approximately Shore 10A to approximately Shore 90D. The orthosis 10 may be formed in various ways, for example, by injection molding, extrusion, compression molding and/or casting.

In one embodiment of the present invention, the spaces 31 between adjacent projections 26 may provide among other things, air flow, advantageous compressional characteristics, and/or advantageous rotational or deformational characteristics such that the projections 26 have a certain degree of structural independence.

Suitable materials for forming the foot orthosis include: thermoplastic such as plasticized polyvinyl chloride; thermoplastic elastomers, such as acrylonitrile-butadiene (nitrile rubber), acrylonitrile-chloroprene, acrylonitrile-isoprene, chlorinated polyethylene, copolyester ether, ethylene-acrylic, ethylene-propylene, ethylene-propylene-diene (EPDM rubber), fluoropolymers, isobutylene-isoprene (or butadiene) (butyl rubber), polyacrylate, polybutadiene, polybutylene, polychloroprene (neoprene rubber), polyepichlorohydrine, polyester, polyether/amide, polyisoprene, polyester-type polyurethane, polyether-type polyurethane, polyester/polyether-type silicone-based styrene-butadiene (buna rubber), styrene-butadiene-styrene, styrene-butylene, styrene-chloroprene, styrene-ethylene, and/or styrene-isoprene; thermoset materials such as polyurethane, and/or unsaturated silicone; rubbers, such as natural; groups of materials such as individual plastics, plastic blends, plastic alloys, and plastic copolymers; and cellular (such as foam) type resins of which can be open cell and closed cell, high density to low density, and polyolefins, for example, polyethylene and/or ionomers.

In one embodiment of the present invention, the foot orthosis 10 can be formed of material selected from a category of plastics known as ethylene propylene thermoplastic vulcanite, for example, thermoplastic elastomers, wherein the material is selected based on its semi-rigidity, flexibility, and durability such that the foot orthosis 10 has advantageous biomechanical characteristics.

The orthosis may be made of a polymer that offers some flexibility and some slight compression to provide comfort when form fit to the user's foot. Additionally, channels 40, 42 located on the bottom of the foot orthosis can be filled with a supplied filler that is compatible with the orthosis material, such as a tube of an uncured silicone polymer that can be applied to the channels and allowed to cure; thus, suiting the users arch height specifications that provides the advantageous support. Cured silicone polymers are available to use in various durometer hardness.

The materials used for the foot orthosis 10, in one embodiment of the present invention, are widely adaptable to users having of many sizes and heights. For example, changes occurring with the user's foot over time or fit to variously used foot hardware can be adapted by adjusting the foot orthosis 10, such as building up or cutting the polymer material in order to obtain the height and length as needed.

In one embodiment of the present invention, the orthosis 10 includes five transverse projections 26 formed integrally with the web portion 12.

Figure 5:
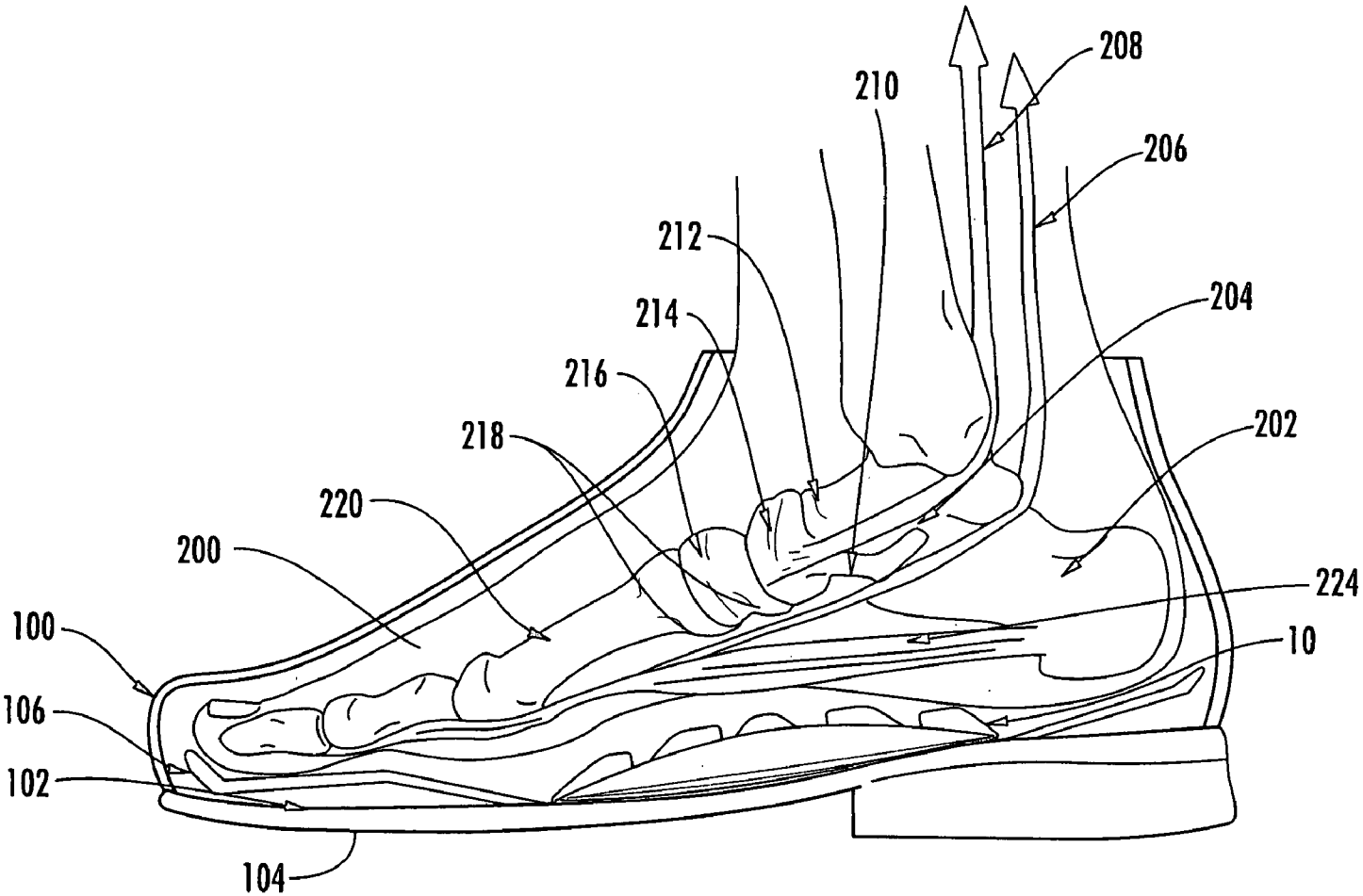
FIG. 5 is a medial side cut away view of a foot orthosis on top of a removable inner sole associated with a footwear assembly including portions of a foot and lower leg consistent with the present invention.
Figure 7:
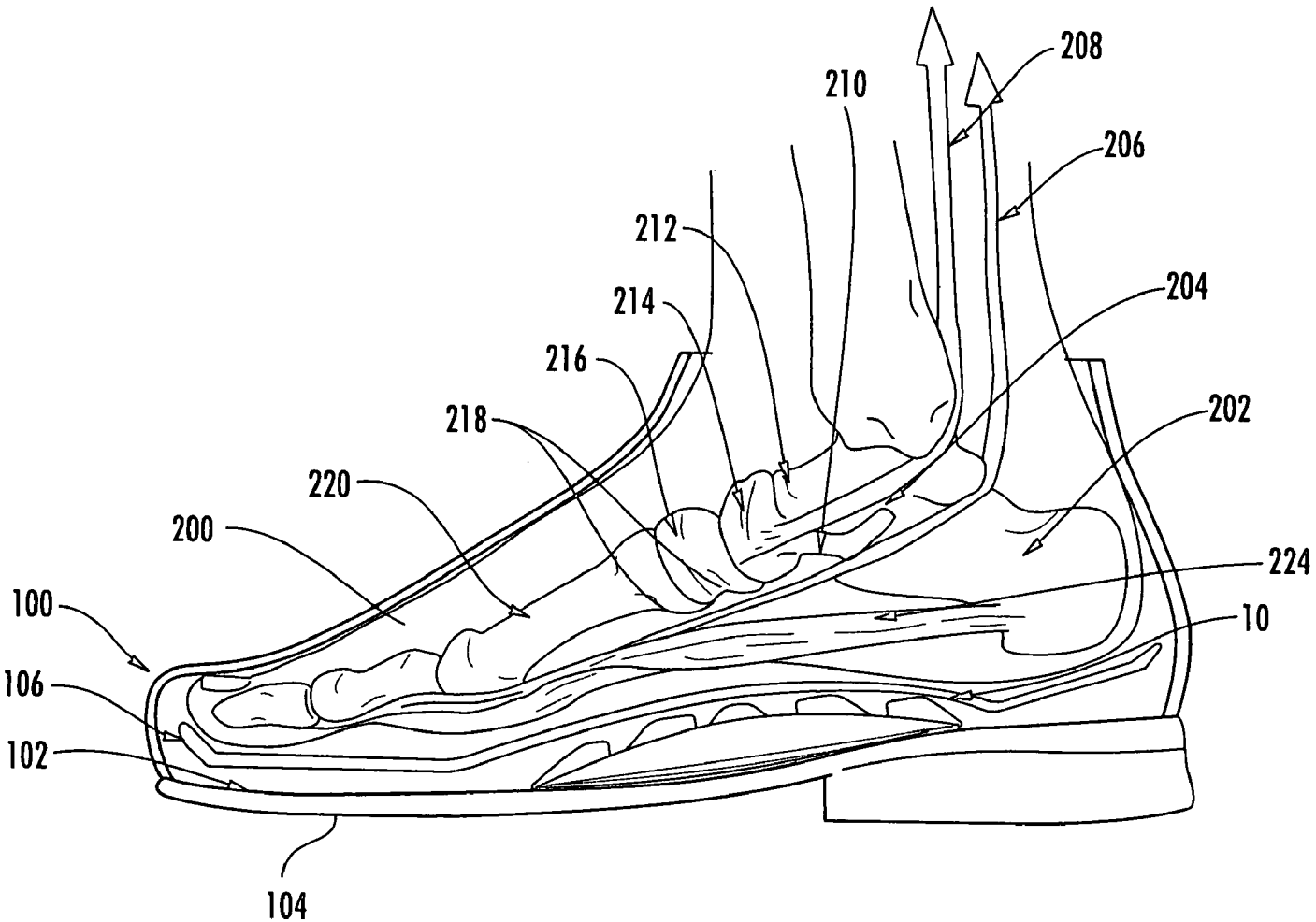
FIG. 7 is a medial side cut away view of a foot orthosis underneath a removable inner sole associated with a footwear assembly including portions of a foot and lower leg consistent with the present invention.
Figure 10:
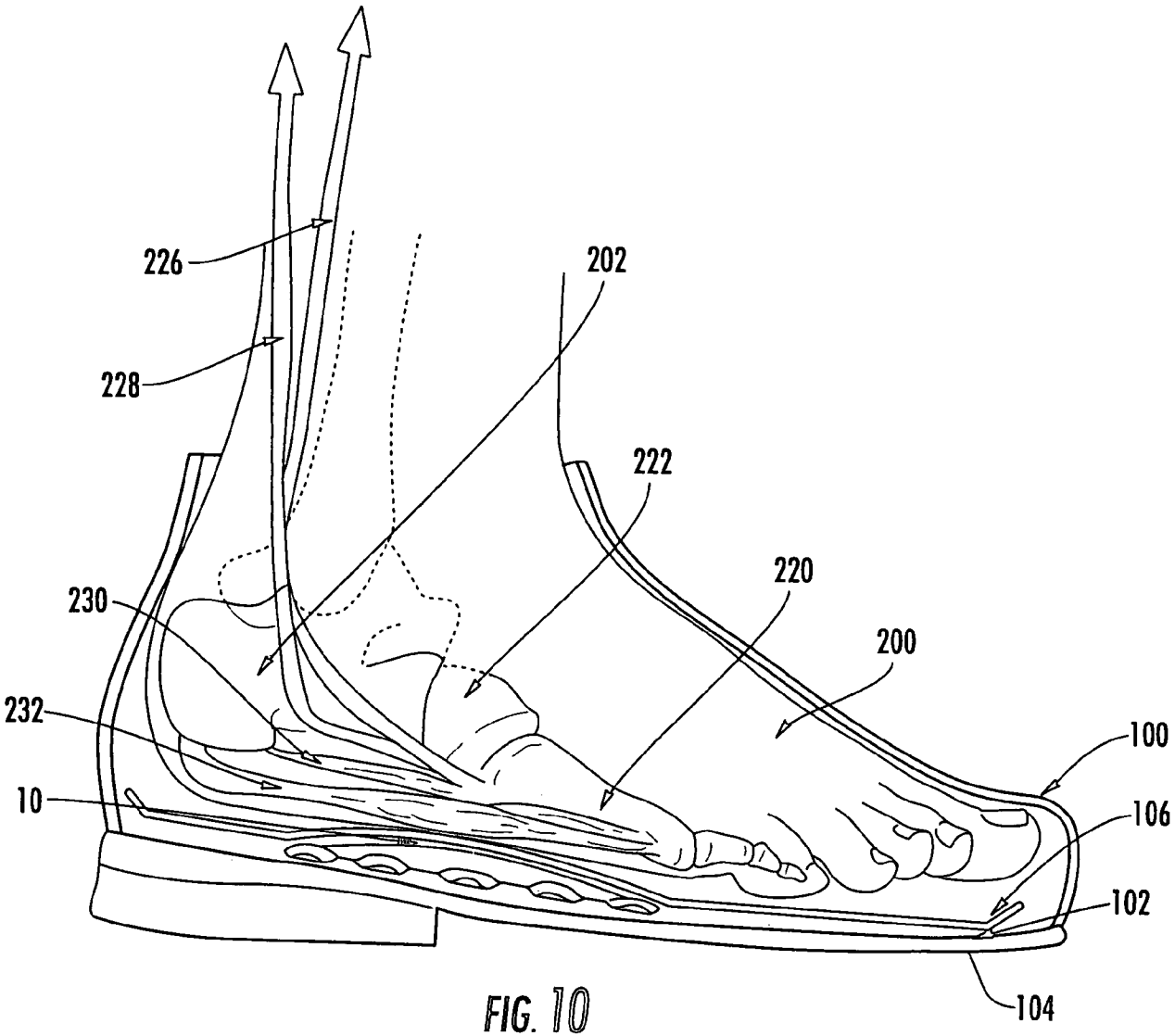
FIG. 10 is a lateral side cut away view of a foot orthosis beneath a removable inner sole associated with a footwear assembly including portions of a foot and lower leg consistent with the present invention.

The transverse projections 26 are positioned along the length of the web portion 12 such that the web portion is configured to substantially extend along an inner side of a user's foot arch. The transverse projections 26 are configured to support the weight bearing muscles, tendons of the muscle group, and ligaments transversely, i.e., perpendicular to the longitudinal direction of the bottom foot muscles, tendons of the muscle group, and ligaments. The specific tendons that the transverse projections 26 may be configured to support include the group of posterior tibialis muscle that contribute to decreasing the impact of the foot strike. In one embodiment of the present invention, the orthosis 10 is used in combination with a footwear assembly such as a sandal, boot, or shoe 100. The shoe 100 may include a platform 102 proximate a bottom surface 104 and a secondary sole element 106 substantially supported by the platform 102. The orthosis 10 may be associated with the shoe 100 in a variety of removable, semi-permanent, or permanent installations. For example, the orthosis 10 may be present intermediate the platform 102 and the secondary sole element 106, as shown in FIGS. 7 and 10, or may be located above the secondary sole element 106. The orthosis may separately rest on, be integral to, or may be adhered to the platform 102 and the secondary sole element 106, as shown in FIGS. 5 and 11.

In one embodiment of the present invention, as shown in FIGS. 5, 7, 10, and 11, the orthosis 10 may be included in a shoe 100 for a foot 200. The foot 200 may dynamically interact with portions of the shoe 100 and orthosis 10. For example, the orthosis 10, may create a curved, elevated, pliable, distributive, and/or other supportive dorsal surface 22 designed to advantageously influence portions of the foot 200. The influence may include modification of the alignment, isolation, force transmission, stability, range of motion, and/or attenuation or enhancement of positional displacement as a function of time of portions of the foot relative to one another. Portions of the foot 200 that may be influenced include, for example, the calcaneous 202, talcalcaneal ligament 204, flexor hallucis longus 206, fibialis posterior 208, calcaneonavicular ligament 210, talus 212, navicular 214, medial cuneiform 216, ligaments 218 joining the cuneiform to the vaicular and metatarsel, metatarsels 220, cuboid 222, abductor hallucis 224, peroneus brevis 226, peroneus longus 228, plantor calcaneocuboid ligament 230, and the long plantar ligament 232. It should be noted that other portions of the foot 200 and/or parts of the body may be influenced by the orthosis 10.

Figure 15:
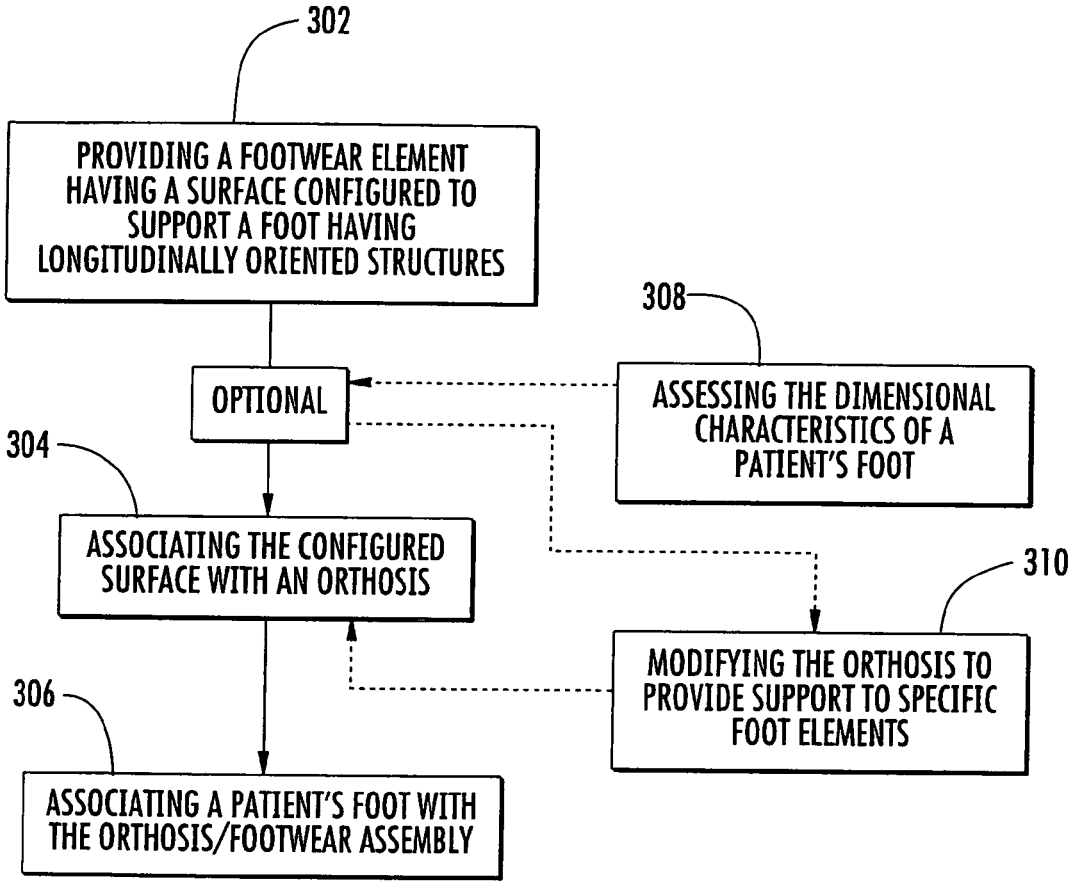
FIG. 15 is a block diagram showing various steps of using the foot orthosis consistent with the present invention.

One embodiment of the present invention also encompasses a method of enabling a user to augment their existing footwear to provide relief of physical discomfort by selectively supporting biological structures of the foot as illustrated in FIG. 15. For example, the method may provide relief from foot pain due to over use of longitudinally directed muscles, tendons, and ligaments located between the metatarsal and calcaneal section of the bottom of a human foot. In one embodiment of the present invention, pain associated with conditions such as plantar fasciitis and/or shin splints may be relieved by including in the step of associating a foot with an orthosis/footwear assembly 306, the step of positioning the orthosis such that the transverse projections are disposed below and are substantially perpendicular to, for example, the plantar fascia.

The method, in one embodiment of the present invention, includes providing a foot orthosis which includes supporting portions of a foot with at least one of the transversely orientated projections such that the web portion extends substantially along the medial foot arch. The transversely orientated projections and/or the web portion may have portions which include a channel or channels. The channels may be partially or fully filled with gas, fluid, semi-solid, gel, solid, or other materials so as to modify the physical characteristics of the transversely orientated projections and/or the web portion. For example, the transversely orientated projections and/or the web portion have channels which are partially or fully filled with material such that biological elements of the user's foot are in contact with, are supported by, and/or may be isolated by the transversely orientated projections and/or the web portion.

Figure 6:
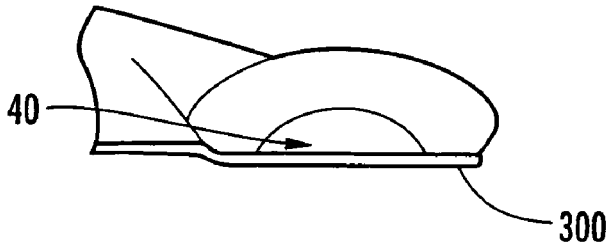
FIG. 6 is a cut away end view of a transverse portion of a foot orthosis having a channel compartmentalized by an associated membrane consistent with the present invention.
Figure 8:
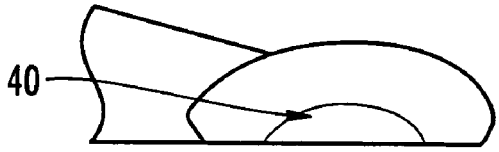
FIG. 8 is a cut away view of transverse portions of a foot orthosis having a channel consistent with the present invention.
Figure 9:
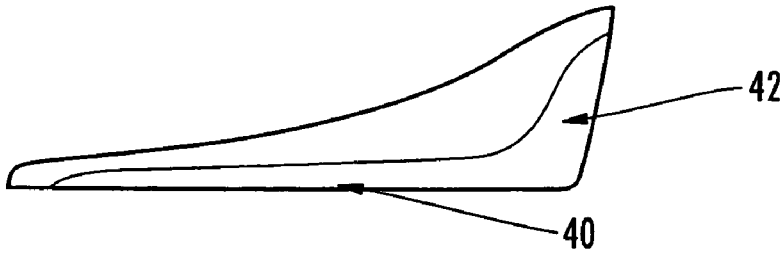
FIG. 9 is a side cut away view of a portion of a foot orthosis having channels in the web portion and transverse portions consistent with the present invention.

In one embodiment of the present invention, the method includes modifying a footwear element for supporting biological structures in a foot. The method comprises providing a footwear element having a surface configured to receive a foot having longitudinally oriented biological structures 302 that among other things form a medial arch and a lateral arch. It should be noted that the biological structure may be, for example, muscle, bone, nerve, ligamentous and/or connective tissues. The configured surface of the footwear element is then associated with an orthosis 304 at a position, for example, where at least one of the medial arch or the lateral arch of the foot will be in supportive contact with a surface of the orthosis such that the longitudinally oriented biological structures are supported by a plurality of individual points of contact along their length. The individual points of contact with respect to a single longitudinally oriented biological structure occurs where, for example, the longitudinally oriented biological structure traverses at least one of the plurality of projections (for example as shown in FIG. 6). The spaces between adjacent projections may provide among other things, airflow, advantageous compressional characteristics, and/or advantageous rotational or deformational characteristics.

Modification of the footwear element can optionally be made after 310 assessing the dimensional characteristics of the foot, for example, of at least one of the medial arch or the lateral arch of the foot. After assessing the dimensional characteristics of the foot 308, the orthosis can be placed at a position such that a plurality of projections are configured to be in supportive contact with individual portions of the longitudinally oriented biological structures.

The method, in one embodiment of the present invention further includes providing a channel in at least one of the plurality of projections such that the configured supportive contact with each of the individual portions of the longitudinally oriented biological structures will advantageously vary as the individual portions exert force against the plurality of projections. For example, the channels may operate to modify the compression profile of portions of the plurality of individual projections. In some cases, a filler material may be included in the channel. The filler may be, for example a gas, liquid, semi-solid, solid, or gel. Such filler materials include, but are not limited to air; inert gases such as argon, and/or nitrogen; water, and aqueous mixtures of alcohol, glycol, silicone; suspensions and pastes; natural and synthetic polymers; and/or silicone and polymeric gels. It should be understood that a wide variety of other materials fall into the filler material categories. For example, foams, felts, cellulosic elements, and/or other natural or synthetic materials.

One embodiment of the present invention includes configuring a portion of at least one of the plurality of projections as a compound arch.

In one embodiment of the present invention, the device can be utilized to correct and/or ameliorate, for example, the condition commonly termed "hammer toe". For example, the orthosis can be placed and/or configured to raise the bone structure at the metatarsal area prior to the toe joint of a hammertoe. When the pressure from the body's full weight is exerted on that area while standing, the support of the orthosis transverse arm pushes the metatarsal bone up and the tip of the toe is pushed down from the exerted weight. During standing with full weight on the area, the positioning of the orthosis transverse arm in this area would allow the stretching the tendons in back of the toe to extend and allowing a slight straightening of the curved hammer toe and concurrently relieving the pressure from a hammer toe that typically produces an irritating metatarsal callus on the bottom of the foot from the metatarsal toe joint.

While preferred embodiments of the foregoing invention have been set forth for purposes of illustration, the foregoing descriptions should not be deemed a limitation of the invention herein. Accordingly, various modifications, adaptations and alternatives may occur to one skilled in the art without departing from the spirit and scope of the present invention.

What is claimed is:

1. An orthosis comprising:

an elongated web portion having, an upper surface, a plantar surface, a medial side, and a lateral side; and a plurality of projections attached to the lateral side of the elongated web portion, said projections extending from a root adjacent the web portion in a substantially perpendicular direction to a lateral terminus, said projections having an upper surface, a plantar surface, a posterior side and an anterior side, at least one of said projections having a variable thickness between said upper surface and said plantar surface, at least a portion of said at least one of said projections is configured as an arch, said variable thickness being greatest intermediate said root and said lateral terminus, wherein the upper surfaces of said elongated web portion and said plurality of projections define an interrupted therapeutically contoured surface, wherein the interruptions are formed by spaces defined in part by the anterior side and the posterior side of adjacent projections.

2. The orthosis of claim 1, wherein at least one of the web portion or the projections include a channel.

3. The orthosis of claim 2, wherein the channel is a channel formed in at least one of the plantar surface of the web portion or in the plantar surface of the projections.

4. The orthosis of claim 2, wherein the channel is substantially enclosed in a material which forms at least one of the web portion or the projections.

5. The orthosis of claim 2, wherein the channel is substantially filled with at least one member of the group consisting of gas, liquid, semi-solid, solid, or gel.

6. The orthosis of claim 2, wherein both said web portion and said projections include a channel and the channel in the projections is contiguous with the channel in the web portion.

7. The orthosis of claim 1, wherein there are five projections and wherein a portion of a projection attached at substantially a midpoint along the web portion includes a highest elevation of the contoured surface.

8. The orthosis of claim 1, wherein an anterior end of the web portion and a posterior end of the web portion both have a thickness which is less than an intermediate portion of the web portion.

9. An orthosis and footwear assembly comprising:

a footwear element having a surface configured for supporting a foot having a medial arch and lateral arch; and an orthosis associated with the configured surface of the footwear, said orthosis having a therapeutically contoured surface for mechanical association with portions of the medial arch and lateral arch of the foot, wherein the orthosis comprises:

an elongated web portion having an upper surface, a plantar surface, a medial side, and a lateral side; and a plurality of projections attached to the lateral side of the elongated web portion, said projections having an upper surface, a plantar surface, a posterior side and an anterior side and extending away from the web portion in a substantially perpendicular direction from a root adjacent said elongated web portion to a lateral terminus, at least one of said projections arranged to support the lateral arch of the foot when said elongated web portion is positioned to support the medial arch of the foot, wherein said therapeutically contoured surface is interrupted by spaces defined between the anterior side and the posterior side of adjacent projections and at least one of the web portion or the projections include a channel formed in at least one of the plantar surface of the web portion or in the plantar surface of the projections.

10. The orthosis and footwear assembly of claim 9, wherein the channel is substantially enclosed in a material which forms at least one of the web portion or the projections.

11. The orthosis and footwear assembly of claim 9, wherein the channel is substantially filled with at least one member of the group consisting of gas, liquid, semi-solid, solid, or gel.

12. The orthosis and footwear assembly of claim 9, wherein both said web portion and said projections include a channel and the channel in the projections is contiguous with the channel in the web portion.

13. The orthosis and footwear assembly of claim 9, wherein the projections extend from the medial arch toward the lateral arch of the foot.

14. The orthosis and footwear assembly of claim 9, wherein the footwear includes a secondary surface in mechanical contact with the orthosis.

15. The orthosis and footwear assembly of claim 14, wherein the secondary surface is in mechanical contact with the contoured surface of the orthosis.

16. The orthosis and footwear assembly of claim 14, wherein the secondary surface is in mechanical contact with the web plantar surface and is in contact with the plantar surface of the projections.

17. A method of modifying a footwear element for supporting biological structures in a foot comprising:

providing a footwear element having a surface configured to support a foot having longitudinally oriented biological structures including a medial arch and a lateral arch;

associating the configured surface of the footwear element with an orthosis at a position where the longitudinally oriented biological structures of the foot will be in supportive contact with a surface of the orthosis such that the longitudinally oriented biological structures are supported by a plurality of individual points of contact along their length;

assessing the dimensional characteristics of at least one of the medial arch or the lateral arch of the foot;

positioning the orthosis at a position such that a plurality of projections are configured to be in supportive contact with individual portions of the longitudinally oriented biological structures forming the assessed dimensional characteristics of at least one of the medial arch or the lateral arch of the foot; and providing a channel in at least one of the plurality of projections such that the configured supportive contact with each of the individual portions of the longitudinally oriented biological structures will advantageously vary as the individual portions exert force against the plurality of projections.

18. The method of claim 17, wherein the step of associating comprises arranging the configured surface of the footwear element at a position where at least one of the medial arch or the lateral arch will be in supportive contact with the footwear element.

19. The method of modifying a footwear element for supporting biological structures in a foot of claim 17 further including the steps of providing a filler material in the channel, wherein the filler is a gas, liquid, semi-solid, solid, or gel.

20. The method of modifying a footwear element for supporting biological structures in a foot of claim 17 further includes the step of configuring a portion of at least one of the plurality of projections as a compound arch.

* * * * *